United States Patent [19]

Seragnoli

[11] Patent Number: 4,570,643

[45] Date of Patent: Feb. 18, 1986

[54] METHOD FOR TRANSFERRING CIGARETTE PIECES

[75] Inventor: Enzo Seragnoli, Bologna, Italy

[73] Assignee: G. D. Societa' per Azioni, Bologna, Italy

[21] Appl. No.: 381,045

[22] Filed: May 24, 1982

[30] Foreign Application Priority Data

Jun. 5, 1981 [IT] Italy ..... 48620 A/81

[51] Int. Cl.[4] ..... A24C 5/00; A24C 5/32

[52] U.S. Cl. ..... 131/94; 131/282

[58] Field of Search ..... 131/282, 283, 94

[56] References Cited

U.S. PATENT DOCUMENTS 4,090,602 5/1978 Schubert et al. ..... 131/282

4,408,621 10/1981 Schumacher ..... 131/282

4,413,640 11/1983 Wahle et al. ..... 131/282

*Primary Examiner*—V. Millin

*Attorney, Agent, or Firm*—Marshall, O'Toole, Gerstein, Murray & Bicknell

[57] ABSTRACT

A method for transferring cigarette pieces from a double rod cigarette manufacturing machine to a filter fitting machine, in which said pieces are transferred at least two at a time, one from each of the two rods, from the horizontal exit bench of the manufacturing machine to the outer surface of the inlet drum of the filter fitting machine of axis parallel to the rods, by means of a plurality of withdrawal elements which undergo a translatory movement along an annular path extending about a first axis parallel to the bench and perpendicular to the rods, while simultaneously undergoing a rocking movement about a second axis parallel to said rods.

8 Claims, 4 Drawing Figures

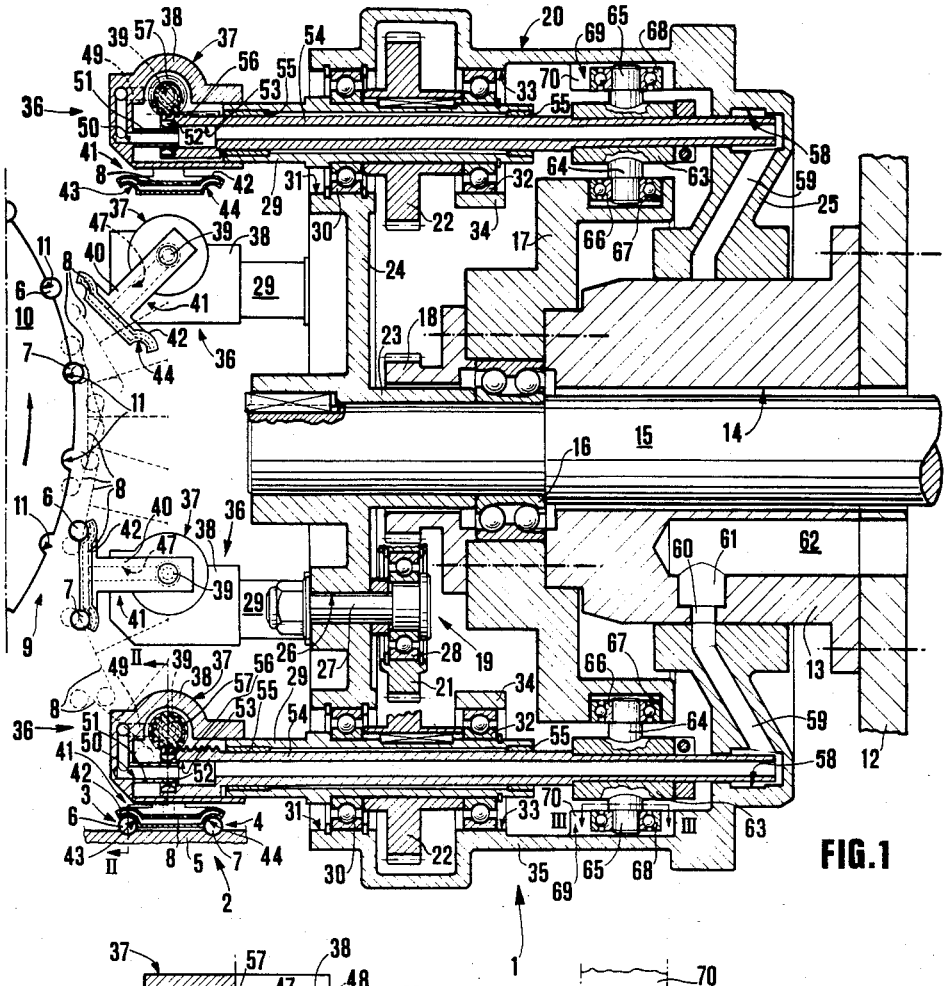
FIG. 1
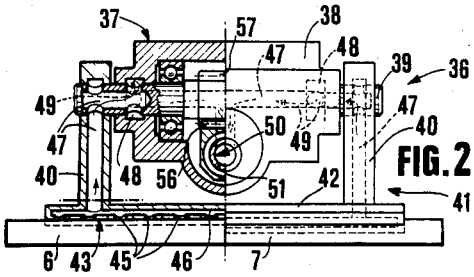
FIG. 2
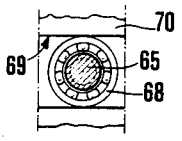
FIG. 3
FIG. 4
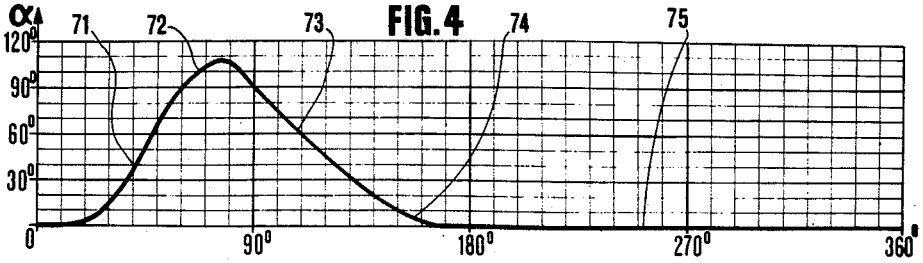

METHOD FOR TRANSFERRING CIGARETTE PIECES

BACKGROUND OF THE INVENTION

This invention relates to a method for transferring cigarette pieces from a double rod cigarette manufacturing machine to a filter fitting machine.

In double rod cigarette manufacturing machines, the two cigarette rods, when formed, are fed parallel to each other along a normally horizontal exit bench.

During their feed along said bench, the rods pass through a cutting station in which they are cut transversely into pieces of equal length which continue to move in the same direction along the bench.

If filter cigarettes are to be produced, said pieces must be transferred from said manufacturing machine bench to a filter fitting machine, of which the inlet station normally consists of a drum conveyor disposed with its axis parallel to the rods and comprising outer axial grooves each arranged to receive at least one cigarette piece.

The aforesaid transfer operation could be easily carried out by using two known transfer devices as normally used on single rod cigarette manufacturing machines, each of said devices cooperating with a respective rod of the double rod machine. However, such a method would obviously require the construction of relatively complicated mechanical structures, which would be of high cost and poor reliability in use.

SUMMARY OF THE INVENTION

The object of the present invention is to provide a method for transferring cigarette pieces from a double rod manufacturing machine to a filter fitting machine by withdrawing said pieces simultaneously from both rods by means of a single mechanism, and transferring them into successive grooves in the inlet drum of one and the same filter fitting machine.

The present invention provides a method for transferring cigarette pieces from a double rod cigarette manufacturing machine to a filter fitting machine, said manufacturing machine being provided with an exit station comprising a bench along which two cigarette rods cut into pieces are fed parallel one to the other, said filter fitting machine being provided with an inlet station comprising a conveyor provided with grooves parallel to said rods and arranged to receive said pieces, the method being characterised by comprising the following stages: moving an element along an annular path extending about a first axis parallel to said bench and perpendicular to said rods, said element being arranged to simultaneously withdraw at least one of said pieces from each of said rods, said path being substantially tangential to said bench, and said withdrawal element being arranged to lie in a position facing said bench when at the point of tangency; and rotating said withdrawal element through a determined angle about a second axis parallel to said rods during its movement along that part of said annular part disposed downstream of said point of tangency so that it becomes disposed in a position facing said conveyor.

The present invention also provides a device, useful in practicing the method, for transferring cigarette pieces from a double rod cigarette manufacturing machine to a filter fitting machine, said manufacturing machine being provided with an exit station comprising a bench arranged to support two parallel rods axially mobile in a determined direction, said filter fitting machine being provided with an inlet station comprising a conveyor provided with grooves parallel to said rods and each arranged to receive at least one of said pieces, characterised by comprising a plurality of transfer units for said pieces, and drive means for causing each of said transfer units to undergo translatory movement along an annular path extending about a first axis parallel to said bench and perpendicular to said rods, said path being substantially tangential both to said bench and to said conveyor; each of said transfer units comprising a withdrawal element for said pieces which is rotatable relative to its transfer unit about a second axis parallel to said rods, transmission means being provided for rotating said withdrawal element through a determined angle about said second axis between a position facing said bench and a position facing said conveyor during the movement of the relative transfer unit along that part of said annular path disposed downstream of a point at which said annular path is substantially tangential to said bench.

BRIEF DESCRIPTION OF THE DRAWINGS

Further characteristics and advantages of the present invention will be apparent from the description given hereinafter with reference to the accompanying drawings, which illustrate a non-limiting embodiment thereof useful in practicing the method, and in which:

FIG. 1 is a cross-section through a device for transferring pieces of a cigarette rod from a double rod manufacturing machine to a filter fitting machine in accordance with the method of the present invention;

FIG. 2 shows a detail of FIG. 1 with parts in full view and parts in sectional view on the line II—II of FIG. 1;

FIG. 3 is a section on the line III—III of FIG. 1; and

FIG. 4 is a diagram showing the plane development of a cam of the transfer device of FIG. 1.

DETAILED DESCRIPTION OF THE INVENTION

FIG. 1 shows a transfer device indicated overall by the reference numeral 1 and disposed downstream of a manufacturing machine 2 arranged to produce two continuous cigarette rods 3 and 4 disposed parallel to each other on a horizontal bench 5 which constitutes the exit station of the machine 2. Before reaching the end of the bench 5, the continuous rods 3 and 4 pass through a cutting station (not shown), at which they are divided into pieces 6 and 7. These pieces are fed at constant speed along the bench 5 in continuous succession with their upper generating lines tangential to a horizontal plane 8 indicated by dashed and dotted lines in FIG. 1.

The device 1 is arranged to transfer at least one piece 6 and at least one piece 7 simultaneously from the manufacturing machine 2 to a filter fitting machine 9, of which the inlet station is constituted by a drum 10. In the example illustrated, each transfer comprises the simultaneous movement of two pieces 6 and two pieces 7 from the machine 2 to the machine 9. The drum 10 is arranged to rotate about an axis (not shown) parallel to the longitudinal axes of the rods 3 and 4, and is disposed above and to the side of the bench 5 of the machine 2. The drum 10 comprises externally a plurality of axial grooves 11 each arranged to receive a pair of aligned cigarette pieces 6, 7, and to retain them in contact with the drum 10 by means of a suction system, not shown.

As shown in FIG. 1, the device 1 comprises a fixed vertical support wall 12 parallel to the axes of the rods 3 and 4 and rigidly supporting a projecting cylindrical bush 13. This latter extends towards the drum 10 and comprises an axial through bore 13 of substantially horizontal axis perpendicular to the rods 3 and 4, which is engaged by a motorised rotatable shaft 15. One end of the shaft 15 emerges from the free end of the bush 13, and by way of a radial bearing 16 supports a drum cam 17.

This latter is rigidly connected to the bush 13, and is disposed between this latter and the sun gear 18 of an epicyclic gear train 19 which in addition to the gear 18 comprises a gear carrier 20, three planet gears 21 (of which only one is shown) uniformly distributed about the gear 18 and rotatably mounted on the gear carrier 20, and six side gears 22 (of which only two are shown) rotatably mounted on the gear carrier 20 external to the gears 21 and engaging with each of these latter in pairs. As shown in FIG. 1, the gear 18 is angularly rigid with the cam 17, and is coaxial to a cylindrical bush 23 keyed on to the free end of the shaft 15 and rigid with an annular disc 24 extending radially outwards from the bush 23 to constitute an end wall of the gear carrier 20.

This latter is substantially cup-shaped so as to enclose in its interior the gear 18 and cam 17, and is closed at its other end by an annular wall 25, of which the inner periphery slides in contact with the outer cylindrical surface of the bush 13. Three equidistant bores 26 (of which only one is shown) are provided through the disc 24, each of which houses a respective fixed pin 27.

By way of a bearing 28, each pin 27 rotatably supports a respective gear 21 on that end thereof facing the interior of the gear carrier 20.

Each gear 22 is keyed on to a respective tubular shaft 29, of which one end extends by way of a radial bearing 30 through a respective through bore 31 provided in the disc 24, and the other end extends by way of a bearing 32 through a bore 33 provided in a respective appendix 34 extending radially inwards from the side wall 35 of the gear carrier 20.

Each shaft 29 supports a respective transfer unit 36 provided with a rotatable head 37 rigid with the relative shaft 29 and comprising a cup member 38 (see also FIG. 2). This latter is traversed by a shaft 39 which is parallel to the rods 3 and 4, and which carries two parallel arms 40 of a rocker element 41 fixed to its opposite ends, which emerge from the cup member 38.

In addition to the two arms 40, the rocker element 41 comprises a withdrawal plate or element 42 which connects together the ends of the arms 40 which are distant from those ends connected to the shaft 39. The plate 42 is disposed outside the cup member 38, and is provided on its outer surface with two grooves 43 and 44 arranged to receive a pair of pieces 6 and a pair of pieces 7 respectively.

As shown in FIG. 2, the pairs of pieces 6 and 7 are retained in the relative grooves 43 and 44 by sucking air through bores 45 provided in the base thereof, and communicating with a chamber 46 disposed inside the plate 42. In its turn, the chamber 46 communicates via suction ducts 47 provided along the arms 40 and shaft 39, with two annular chambers 48 provided in the cup member 38 (FIG. 2 shows only that one which communicates with the duct 47 of the left hand arm 40).

From these latter there extend respective ducts 49, which are provided within the wall of the cup member 48 and communicate with an axial through bore 50 provided through a pin 51 disposed in a position substantially coaxial to the axis of rotation of the rotatable head 37 and extending towards the wall 25 in a direction parallel to the shaft 15 from an inner surface of the cup member 38.

The free end of the pin 51 rotatably engages, in a fluid-tight manner by way of a gasket 52, an axial bore 53 in a tubular shaft 54, of which an intermediate portion is rotatably supported in the tubular shaft 29 by way of two bearings 55.

A first end portion of the shaft 54 extends out of the tubular shaft 29 and into the cup member 38, and on that outer surface thereof which faces the shaft 39 it carries a rack 56 which engages with a pinion 57 keyed on to the shaft 39. A second end portion of the shaft 54 extends out of the tubular shaft 29 at the opposite end to the rotatable head 37, and rotatably engages a dead bore 58 by way of which the bore 53 of the shaft 54 communicates with a radial channel 59 provided within the wall 25. In its turn, the channel 59 communicates with an annular groove 60 provided in the outer surface of the bush 13 and extending through an angle of about 90°. By way of a radial bore 61 in its base, the groove 60 communicates with an axial channel 62 provided within the wall of the bush 13 and communicating in its turn with an air suction device (not shown). A rotatable bush 63 is mounted in an axially fixed position on that portion of the tubular shaft 54 extending between the wall 25 and the tubular shaft 29, and is provided with two outer coaxial radial pins 64 and 65, of which the first supports a bearing 66 mounted with its outer race disposed in contact with the lateral surfaces of an annular track 67 provided in the lateral surface of the drum cam 17, and of which the pattern is described hereinafter with reference to FIG. 4.

The pin 65 supports a radial bearing 68, of which the outer race is mounted, as shown in FIG. 3, inside an annular groove 69 provided in the inner surface of a pad 70 rigid with the inner surface of the side wall 35 of the gear carrier 20. The diagram of FIG. 4 shows the pattern of the track 67 extending along the abscissa axis, the ordinate axis showing the angles of rotation, indicated by $\alpha°$, of each shaft 39, which correspond to the displacement of the axis of the track 67 relative to a base plane perpendicular to the axis of the shaft 15.

In the transfer device 1 heretofore described, a rotation of the shaft 15 leads to a corresponding rotation of the gear carrier 20 about its axis, with consequent rolling of the planet gears 21 about the sun gear 18. This latter is fixed in that it is rigid with the wall 12 by way of the cam 17 and bush 13. A rotation of the planet gears 21 about their axes leads to a corresponding rotation in the opposite direction of the side gears 22.

Consequently, if as in the example illustrated the gears 22 are identical to the sun gear 18, the rotation of the shaft 15 about its axis causes the gears 22 to translate about said axis.

Consequently the shafts 29 and heads 37 also translate about said axis, the shafts 39 of the heads 37 always remaining parallel to the rods 3 and 4, and their pinions 57 always remaining engaged with the relative racks 56.

The operation of the transfer device 1 is described hereinafter with reference to the lowest transfer unit 36 in FIG. 1 and starting from the illustrated position thereof.

The rotation of the shaft 15 about its axis causes the units 36 to move along an annular path which is substantially tangential both to the bench 5 and to the drum 10.

When a unit 36, as a result of the rotation of the shaft 15, lies immediately above the bench 5 in a substantially tangential position thereto and with its plate 42 facing and parallel to the rods 3 and 4, the relative channel 59 comes into communication with the annular groove 60 to produce a vacuum inside the bore 53 and chamber 46.

This vacuum causes air to be drawn through the bores 45 with the result that a pair of pieces 6 and a pair of pieces 7 become locked in the respective grooves 43 and 44.

Consequently, as the rotation of the shaft 15 proceeds, the aforesaid unit 36 separates from the bench 5 and removes the said two pairs of pieces 6 and 7 therefrom.

As stated heretofore, the head 37 of said unit 36 rises from the bench 5 in a manner parallel thereto, while the bearing 66 connected to the bush 63 of the relative shaft 54 moves along the track 67.

The shaft 54 rotates about its axis dragged by the relative head 37 by virtue of said engagement between the pinion 57 and rack 56, and any undesirable oscillation of the bush 63 about the shaft 54 is prevented by the presence of the bearing 68 engaged in the groove 69.

As shown in FIG. 4, the bearing 66 moves, from its position shown in FIG. 1, firstly along the track 67 through a portion 71 of substantially constant inclination and extending through an arc of about 60°. Through this portion 71, said shaft 54 is moved axially forwards towards the relative head 37 so that its rack 56 and the relative pinion 57 cause the relative shaft 39 and rocker element 41 to rotate through about 90°.

As a result of this rotation of the rocker element 41, the plate 42 rotates outwards about the axis of the relative shaft 39 so that its plane 8 becomes positioned substantially perpendicular to the bench 5 and its grooves 43 and 44 face the drum 10 of the machine 9.

During the next 30° of rotation of the shaft 15, the bearing 66 passes through a portion 72 of the track 67, along a first part of which the shaft 54 is urged further forwards so as to move the relative plane 8 into a position substantially tangential to the roller 10 so as to cause the two pieces 7 disposed to the rear with respect to the direction of motion of the plate 42 to become inserted into a relative groove 11 of the drum 10. Substantially at the same moment as the pieces 7 become inserted into a groove 11, the shaft 54 begins to withdraw, to cause progressive anti-clockwise rotation of the relative rocker element 41 about the shaft 39 (descending part of the portion 72).

During the next 45° of rotation of the shaft 15, the bearing 66 passes through a descending portion 73 of the track 67. The two front pieces 6 become transferred into a relative groove 11 of the drum 10 while the bearing 66 is passing through said portion 73, under such conditions that the translatory speed of the plate 42 and the peripheral speed of the drum 10 are substantially equal.

During the final stage of the first half revolution of the shaft 15, the bearing 66 passes through a descending portion 74 of the track 67 shaped such as to return the plane 8 into its initial position parallel to the bench 5.

During the next half revolution of the shaft 15, the bearing 66 of said unit 36 travels through a portion 75 of the track 67 shaped such as to keep the shaft 54 in an axially fixed position.

From the aforegoing, it is apparent that in order to enable the unit 36 to simultaneously remove pairs of pieces 6 and 7 from the two rods 3 and 4, the described transfer device 1 firstly causes each plate 42 to translate along an annular path substantially tangential to the bench 5 and extending about an axis parallel to the bench 5 and perpendicular to the feed direction of the rods 3 and 4.

During said circular translation, each plate 42, when tangential to the bench 5, has attained a speed of movement substantially equal to that of the rods 3 and 4, so as to be able to withdraw the pieces 6 and 7.

Following the withdrawal, each plate 42 is rotated substantially through 90° about an axis parallel to the feed direction of the rods 3 and 4 while continuing to translate along said annular path, so that over a certain portion of this latter it lies in a position substantially tangential to the outer periphery of the drum 10.

Finally, the device 1 transfers the pieces 6 and 7 from each plate 42 to the drum 10 by causing the plates 42 to substantially "land" in succession on the outer surface of the drum 10, firstly with its rear end and then with its front end.

This operation, which is carried out in the described manner in order to prevent any possible collision and/or jamming of the plates 42 on the outer surface of the drum 10, is executed by making the plates 42 rock about their 90°-rotated position. By means of these rocking movements it is possible to make the velocity vector of the pieces 7 and, subsequently, the velocity vector of the pieces 6 equal the velocity vectors of the grooves 11 which respectively face them.

The transfer of the pieces 6 and 7 from each unit 36 to the drum 10 of the machine 9 terminates by leaving the pieces inside the relative grooves 11 when communication between the channel 59 of the relative unit 36 and the groove 60 becomes interrupted. Within the principle of the invention, numerous modifications can be made to the described transfer device 1 without leaving the scope of the present invention.

What we claim is:

1. A method for transferring cigarette pieces (6, 7) from a double rod cigarette manufacturing machine (2) to a filter fitting machine (9), said manufacturing machine (2) being provided with an exit station comprising a bench (5) along which two cigarette rods (3, 4) cut into pieces (6, 7) are fed along parallel paths, said filter fitting machine (9) being provided with an inlet station comprising a conveyor (10) provided with grooves (11) parallel to said rods (3, 4) and arranged to receive said pieces (6, 7), said method comprising the following steps:

moving a withdrawal element (42) along an annular path extending about a first axis parallel to said bench (5) and perpendicular to said rods (3,4), said withdrawal element being arranged to simultaneously withdraw at least one of said pieces (6, 7) from each of said rods (3, 4), said annular path being substantially tangential to said bench (5), and said withdrawal element (42) being arranged to lie in a position facing said bench (5) when at the point of tangency; and rotating said withdrawal element (42), through a predetermined angle, about a second axis (39) parallel to said rods (3, 4) during its movement along a part of said annular path which is disposed downstream of said point of tangency so that the withdrawal element is positioned to face said conveyor (10).

2. A method as claimed in claim 1, wherein said angle is about 90°.

3. A method as claimed in claim 1, further including the step of rocking said withdrawal element (42) about said second axis (39) after it has rotated through said predetermined angle, so as to transfer on to said conveyor (10) firstly at least one piece (7) disposed to the rear and then at least one piece (6) disposed to the front of said withdrawal element (42) with reference to the direction of movement of said withdrawal element (42) along said annular path.

4. A method as claimed in claim 1, wherein said withdrawal element (42) comprises a flat plate provided with two side-by-side parallel grooves (43, 44) arranged to receive said pieces (6, 7) of said two rods (3, 4) on said bench (5), said plate being provided with suction means (45) for retaining said pieces (6, 7) within said grooves (43, 44).

5. A method as claimed in claim 1, wherein the axes of said pieces (6, 7) retained by said withdrawal element (42) undergo simple translatory motion during the movement of said withdrawal element (42) along said annular path.

6. A method as claimed in claim 5, wherein said translatory motion is obtained by means of an epicyclic gear train (19) comprising a fixed sun gear (18), a rotatable gear carrier (20), drive means (15) for rotating said gear carrier (20) about an axis which coincides with the axis of said sun gear (18), a plurality of side gears (22) rotatably mounted on said gear carrier (20) each of which support gears (22) supports a respective withdrawal element (42), and a plurality of planet gears (21) rotatably mounted on said carrier (20) each disposed between one of said side gears (22) and said sun gear (18), said sun gear (18) being identical to said side gears (22).

7. A method as claimed in claim 6, wherein said second axis (39) coincides with the axis of rotation of a pinion (57) coupled to a rack (56) supported by a respective said side gear (22), said rack being axially slidable in a direction parallel to the axis of said side gear (22), said pinion (57) being rigidly affixed on a shaft (39) to which a respective said withdrawal element (42) is coupled for rotation.

8. A method as claimed in claim 7, wherein the axial movement of said rack (56) is controlled by a cam (17).

* * * * *